US012686100B2

(12) United States Patent
Lee et al.

(10) Patent No.: US 12,686,100 B2
(45) Date of Patent: Jul. 21, 2026

(54) CLEANER FOR CHEMICAL MECHANICAL POLISHING APPARATUS

(71) Applicant: SAMSUNG ELECTRONICS CO., LTD., Suwon-si (KR)

(72) Inventors: Jubong Lee, Suwon-si (KR); Jongsu Kim, Suwon-si (KR); Sungyong Park, Suwon-si (KR); Bongki Park, Suwon-si (KR); Eunsun Park, Suwon-si (KR); Hyunjoon Park, Suwon-si (KR); Hoseop Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 463 days.

(21) Appl. No.: 18/226,873

(22) Filed: Jul. 27, 2023

(65) Prior Publication Data

US 2024/0208005 A1 Jun. 27, 2024

(30) Foreign Application Priority Data

Dec. 22, 2022 (KR) ..... 10-2022-0181579

(51) Int. Cl.
*B24B 53/017* (2012.01)
*B24B 37/005* (2012.01)
*B24B 37/04* (2012.01)

(52) U.S. Cl.
CPC ..... *B24B 53/017* (2013.01); *B24B 37/005* (2013.01); *B24B 37/04* (2013.01)

(58) Field of Classification Search
CPC ..... B24B 53/017
See application file for complete search history.

(56) References Cited

U.S. PATENT DOCUMENTS

| | | | |
|---|---|---|---|
| 6,505,636 | B1 | 1/2003 | Travis |
| 9,434,044 | B2 | 9/2016 | Kosuge et al. |
| 2022/0161390 | A1 | 5/2022 | Cho |

FOREIGN PATENT DOCUMENTS

| | | | |
|---|---|---|---|
| JP | 2008-272902 | A | 11/2008 |
| JP | 2013-240846 | A | 12/2013 |
| KR | 10-1322410 | B1 | 10/2013 |
| KR | 10-2368797 | B1 | 2/2022 |

*Primary Examiner* — Jason Y Ko
(74) *Attorney, Agent, or Firm* — Muir Patent Law, PLLC

(57) ABSTRACT

A cleaner for a CMP apparatus includes a cleaning body, a plurality of cleaning nozzles, a vision system and a controller. The cleaning body may be arranged under a polishing head of the CMP apparatus configured to hold a substrate. The cleaning body may be configured to receive a cleaning solution for cleaning the polishing head. The cleaning nozzles may be arranged at the cleaning body to inject the cleaning solutions to the polishing head. The vision system may photograph the polishing head to which the cleaning solution may be injected to obtain an image of the polishing head. The controller may individually control amounts of the cleaning solutions injected from the cleaning nozzles based on the image of the polishing head. Thus, a scratch caused by a defect may not be generated at the substrate.

20 Claims, 10 Drawing Sheets

CLEANER FOR CHEMICAL MECHANICAL POLISHING APPARATUS

CROSS-REFERENCE TO RELATED APPLICATION

This application claims priority under 35 USC § 119 to Korean Patent Application No. 10-2022-0181579, filed on Dec. 22, 2022, in the Korean Intellectual Property Office (KIPO), the contents of which are herein incorporated by reference in their entirety.

BACKGROUND

1. Field

Example embodiments relate to a cleaner for a chemical mechanical polishing apparatus. More particularly, example embodiments relate to a cleaner configured to clean a polishing pad of a chemical mechanical polishing apparatus.

2. Description of the Related Art

Generally, a layer on a semiconductor substrate may be planarized using a chemical mechanical polishing (CMP) apparatus. The CMP apparatus may include a polishing head configured to hold the semiconductor substrate, a platen arranged under the polishing head, a polishing pad arranged on an upper surface of the platen to polish the semiconductor substrate, a slurry arm configured to supply slurry to the polishing pad, etc.

SUMMARY

According to example embodiments, there may be provided a cleaner for a CMP apparatus. The cleaner may include a cleaning body, a plurality of cleaning nozzles, a vision system and a controller. The cleaning body may be arranged under a polishing head of the CMP apparatus to hold a substrate. The cleaning body may be configured to receive a cleaning solution for cleaning the polishing head. The cleaning nozzles may be arranged at the cleaning body to inject the cleaning solutions to the polishing head. The vision system may photograph the polishing head to which the cleaning solution may be injected to obtain an image of the polishing head. The controller may individually control amounts of the cleaning solutions injected from the cleaning nozzles based on the image of the polishing head.

According to example embodiments, there may be provided a cleaner for a CMP apparatus. The cleaner may include a cleaning body, a plurality of cleaning nozzles, a vision system and a controller. The cleaning body may be arranged under a polishing head of the CMP apparatus to hold a substrate. The cleaning body may be configured to receive a cleaning solution for cleaning the polishing head. The cleaning nozzles may be arranged at the cleaning body to inject the cleaning solutions to a lower surface of the polishing head. The vision system may photograph the polishing head to which the cleaning solution may be injected to obtain an image of the lower surface of the polishing head. The controller may individually control amounts of the cleaning solutions injected from the cleaning nozzles based on the image of the lower surface of the polishing head. The cleaning body may have a curvature corresponding to an outer circumferential surface of a platen, which may be arranged under the polishing pad, to have an arc shape configured to closely make contact with the outer circumferential surface of the platen. The cleaning nozzles may include a plurality of main nozzles and at least one auxiliary nozzle. The main nozzles may be arranged in a first curvature line of the cleaning body. The auxiliary nozzle may be arranged in a second curvature line of the cleaning body. The vision system may include an illuminator, a camera and a blower. The illuminator may illuminate the lower surface of the polishing head. The camera may photograph the lower surface of the polishing head illuminated by the illuminator. The blower may inject a gas to the polishing head to remove particles from the lower surface of the polishing head photographed by the camera. Each of the cleaning nozzles may be individually connected to a plurality of cleaning solution lines through which the cleaning solutions may flow. A plurality of valves may be arranged on the cleaning solution lines to control amounts of the cleaning solutions. The controller may control operations of the valves.

According to example embodiments, there may be provided a cleaner for a CMP apparatus. The cleaner may include a cleaning body with an interior space, the interior space being configured to accommodate a cleaning solution for cleaning a polishing head, and the cleaning body being arranged under the polishing head that holds a substrate; cleaning nozzles extending from the cleaning body, the cleaning nozzles being configured to inject the cleaning solution to the polishing head; a vision system configured to photograph the polishing head to obtain an image of the polishing head; and a controller configured to individually control amounts of the cleaning solution injected from the cleaning nozzles based on the image of the polishing head. The cleaning body is positioned between a platen with a polishing pad and a load/unload stage of the polishing head. The cleaning body includes inlet holes at opposite side surfaces of the cleaning body, the inlet holes being connected to a cleaning solution supply. A fitting is connected to one of the inlet holes, the fitting being selectively connected to a duct of the cleaning solution supply. A cover is connected to another of the inlet holes, the cover covering the interior space of the cleaning body.

BRIEF DESCRIPTION OF THE DRAWINGS

Features will become apparent to those of skill in the art by describing in detail exemplary embodiments with reference to the attached drawings, in which.

DETAILED DESCRIPTION

Hereinafter, example embodiments will be explained in detail with reference to the accompanying drawings.

Figure 1:
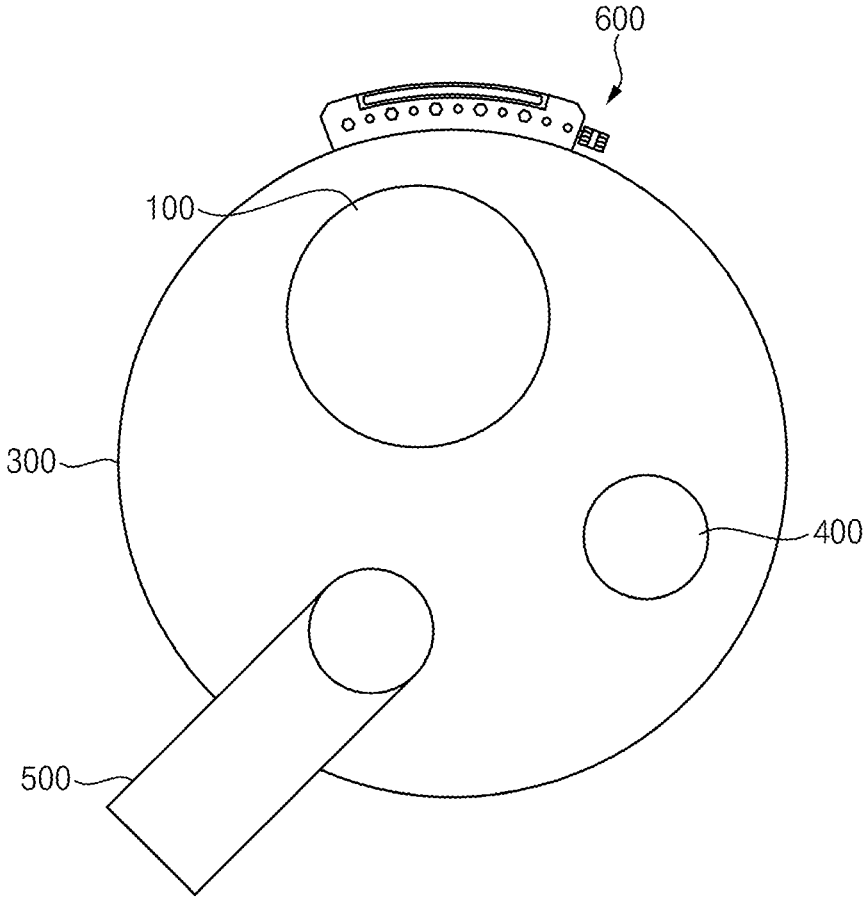
FIG. 1 is a plan view illustrating a CMP apparatus in accordance with example embodiments.
Figure 2:
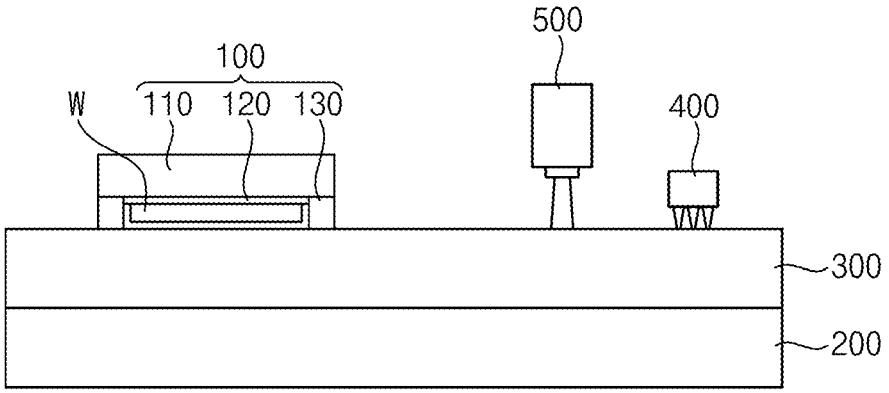
FIG. 2 is a cross-sectional view illustrating the CMP apparatus in FIG. 1.
Figure 3:
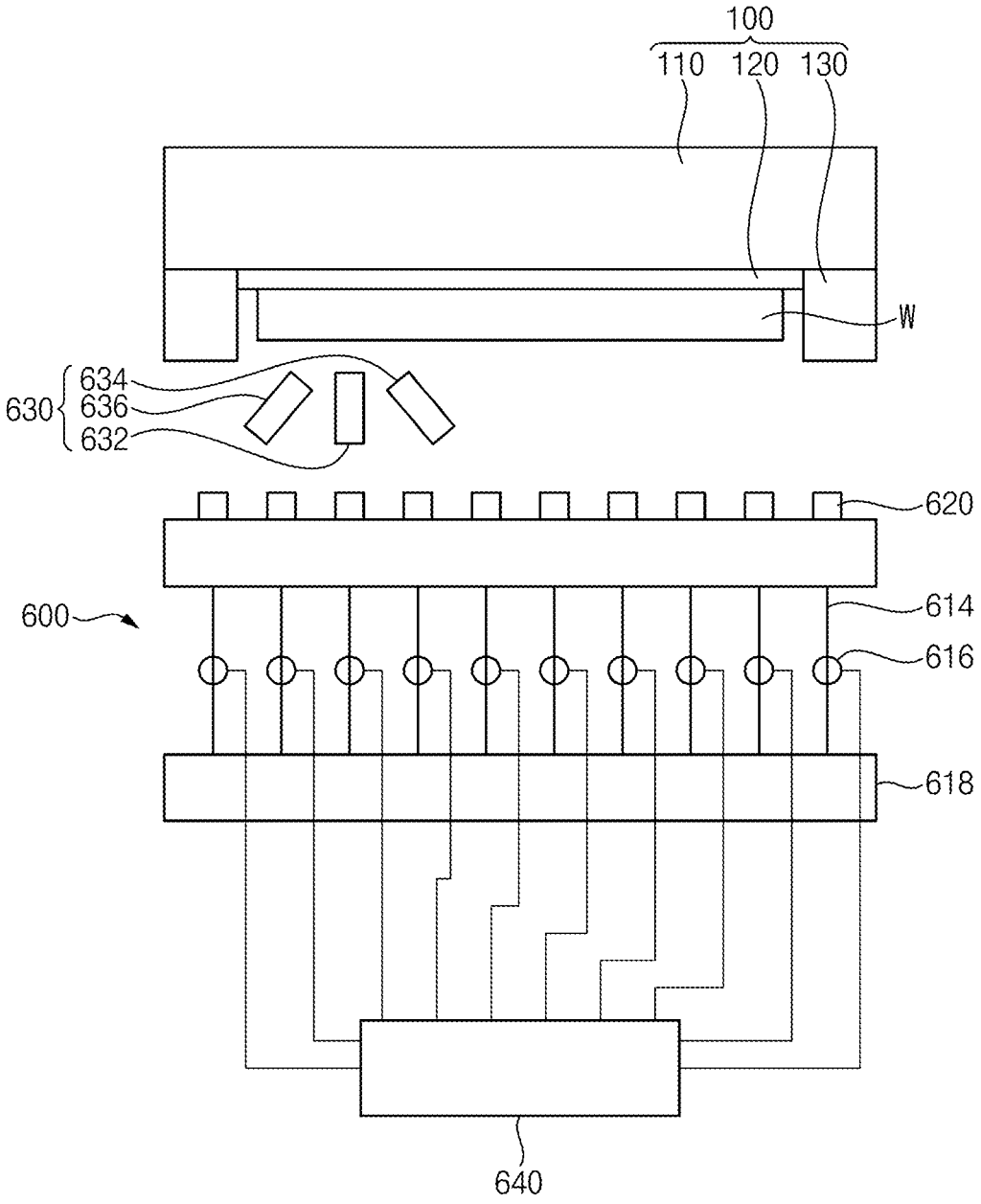
FIG. 3 is an enlarged cross-sectional view illustrating a polishing pad and a cleaner of the CMP apparatus in FIG. 2.

FIG. 1 is a plan view illustrating a CMP apparatus in accordance with example embodiments, FIG. 2 is a cross-sectional view illustrating the CMP apparatus in FIG. 1, and FIG. 3 is an enlarged cross-sectional view illustrating a polishing pad and a cleaner of the CMP apparatus in FIG. 2.

Referring to FIGS. 1 to 3, a CMP apparatus according to example embodiments may include a polishing head 100, a platen 200, a polishing pad 300, a slurry arm 500, a conditioner 400, and a cleaner 600.

The polishing head 100 may be configured to hold a substrate W. The substrate W may be fixed to a lower surface of the polishing head 100. The polishing head 100 may be moved between the platen 200 and a load/unload stage 700 (See FIG. 4).

For example, the polishing head 100 may include a base 110, a membrane 120, and a retainer ring 130. The base 110 may receive vacuum to hold the substrate W.

The membrane 120 may be arranged on a central portion of the lower surface of the polishing head 100. The membrane 120 may contact the substrate W. That is, the membrane 120 may function as a substrate-holding surface for holding the substrate W.

The retainer ring 130 may be arranged on an edge portion of the lower surface of the polishing head 100 to surround the membrane 120. The retainer ring 130 may support an outer circumferential surface of the substrate W in a CMP process. The retainer ring 130 may be spaced apart from the membrane 120 to form a gap between the retainer ring 130 and the membrane 120.

The platen 200 may be arranged under the polishing head 100. The polishing pad 300 may be arranged on an upper surface of the platen 200. The platen 200 may be rotated with respect to a vertical axis. Thus, the polishing pad 300 may also be rotated together with the platen 200 with respect to the vertical axis. The polishing pad 300 may polish a layer, e.g., a metal layer, on the substrate W using slurry provided from the slurry arm 500. The slurry may include, e.g., an oxidizing agent.

The conditioner 400 may be arranged over the platen 200. The conditioner 400 may include a conditioning disk configured to condition the polishing pad 300.

The cleaner 600 may be configured to clean the polishing head 100 using cleaning solutions. In detail, the cleaner 600 may clean the lower surface of the polishing head 100, i.e., the membrane 120 and the retainer ring 130. The cleaner 600 may remove a defect, e.g., a particle, which may be generated in the CMP process, remaining in the gap between the membrane 120 and the retainer ring 130. The cleaning solutions may include, e.g., deionized (DI) water. The cleaner 600 may include a cleaning body 610, a plurality of cleaning nozzles, a vision system 630, and a controller 640, which will be described in detail with reference to FIGS. 4-6.

Figure 4:
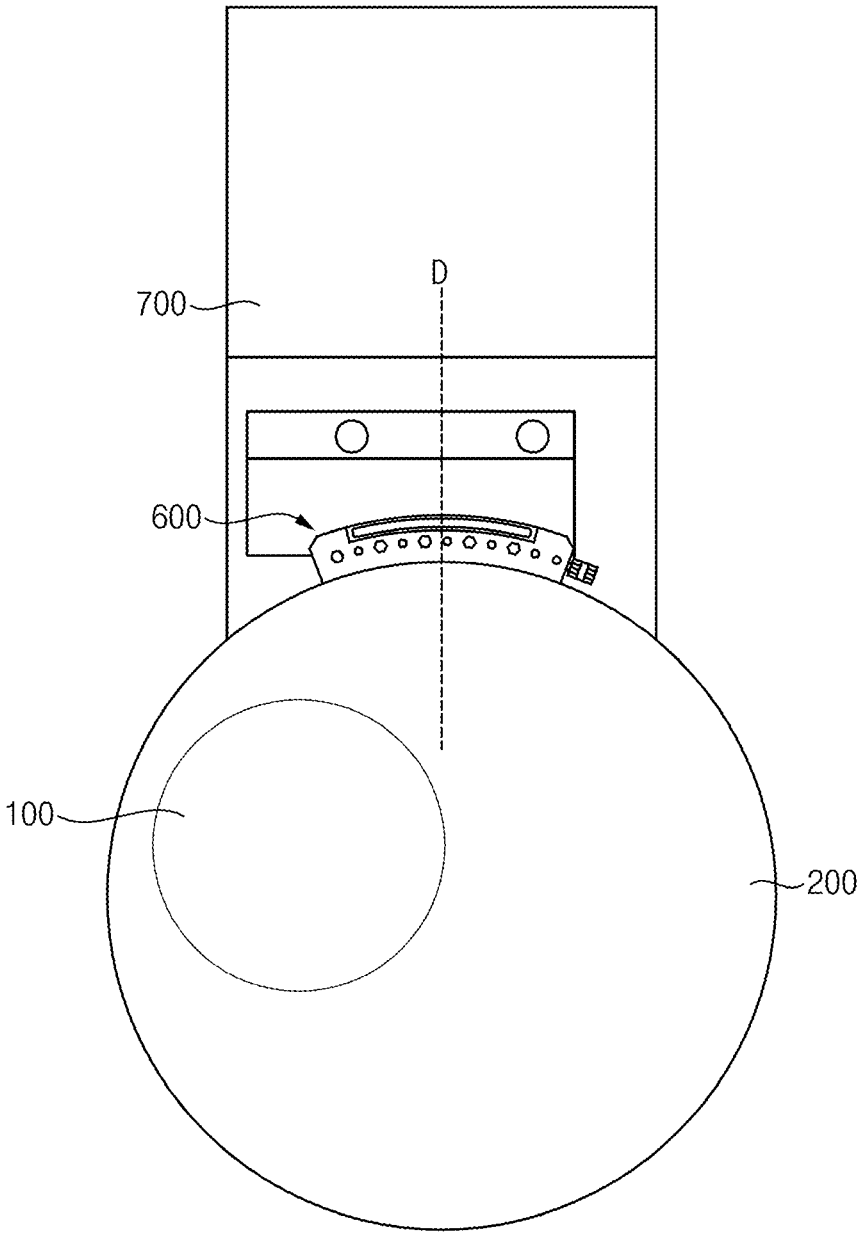
FIG. 4 is a plan view illustrating the cleaner and a platen in FIG. 3.
Figure 5:
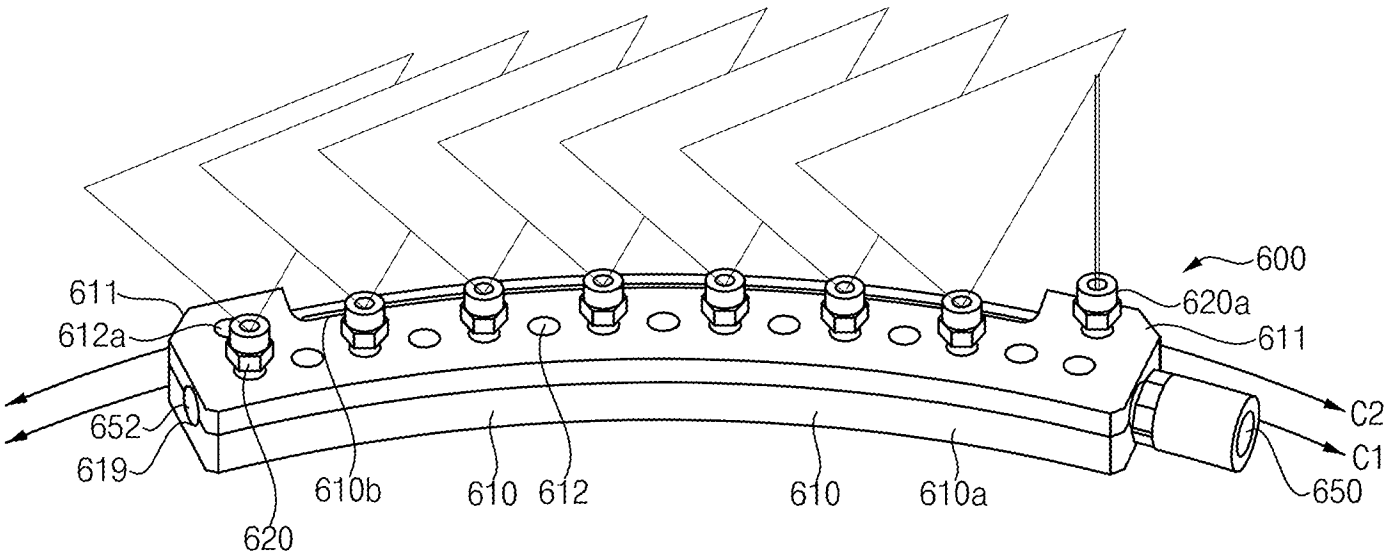
FIG. 5 is a perspective view illustrating the cleaner in FIG. 4.
Figure 6:
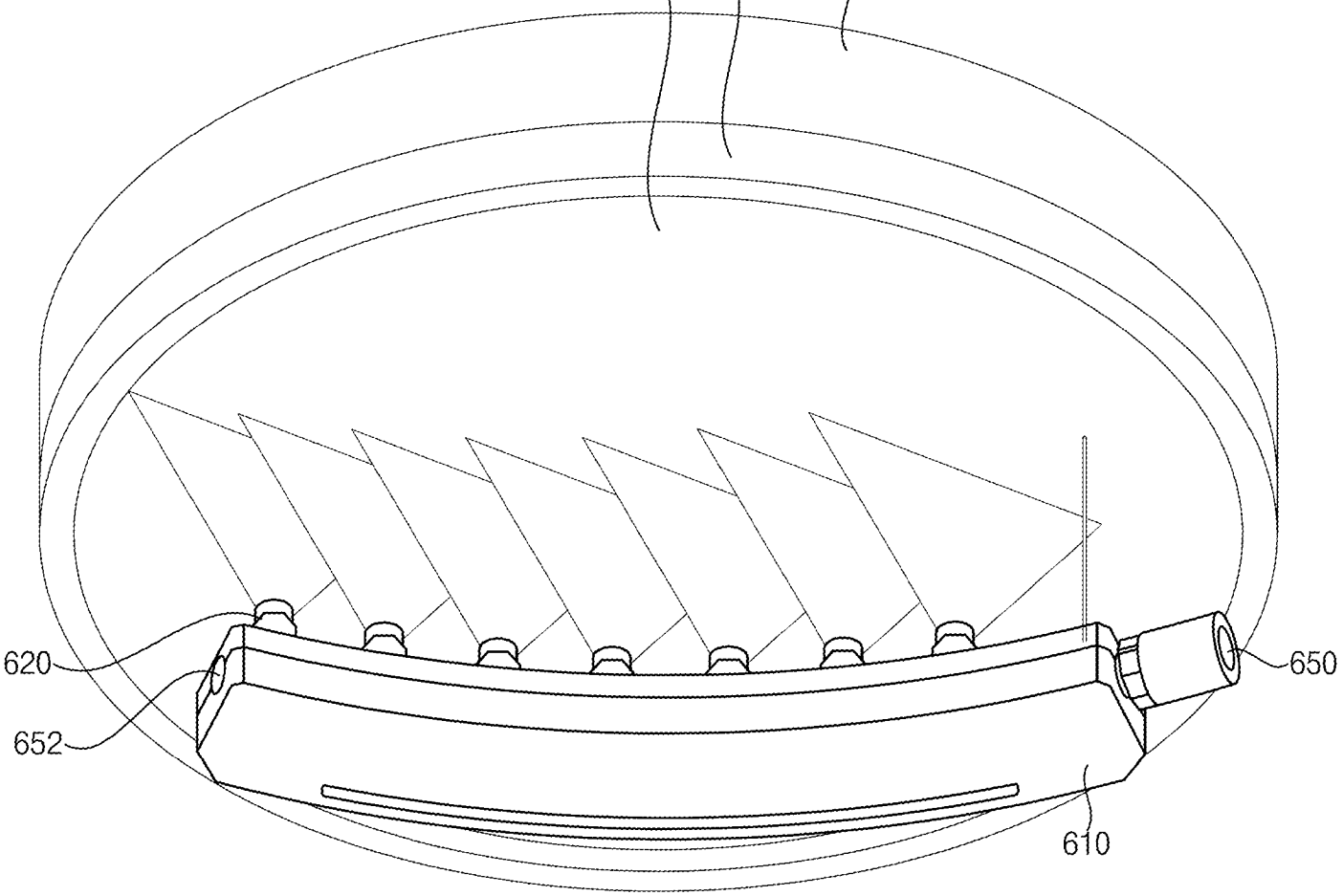
FIG. 6 is a perspective view illustrating a membrane and a retainer ring of a polishing pad cleaned by cleaning solutions injected from the cleaner in FIG. 5.

FIG. 4 is a plan view illustrating the cleaner 600 and the platen 200 in FIG. 3, FIG. 5 is a perspective view of the cleaner 600 in FIG. 4, and FIG. 6 is a perspective view of the membrane 120 and the retainer ring 130 cleaned by cleaning solutions injected from the cleaner 600 in FIG. 5.

Referring to FIGS. 4 to 6, the cleaning body 610 may be positioned between the platen 200 and the load/unload stage 700. In detail, the cleaning body 610 may be placed adjacent to the platen 200, e.g., the cleaning body 610 of the cleaner 600 may be attached to a side surface of the platen 200 that faces the load/unload stage 700 in a horizontal direction parallel to the top of the platen 200. The cleaning body 610 may contact (e.g., directly contact) an outer circumferential surface of the platen 200. Because the cleaning body 610 contacts the outer circumferential surface of the platen 200, it may not be required to provide an additional space for arranging the cleaning body 610 in the CMP apparatus.

Referring to FIGS. 3 and 6, the cleaning body 610 may be arranged under the polishing head 100. For example, while the polishing head 100 moves between the platen 200 and the load/unload stage 700, the polishing head 100 may move over the cleaning body 610 of the cleaner 600, so a lower surface of the polishing head 100 (i.e., the membrane 120 and the retainer ring 130) overlaps the top of the cleaning body 610.

In example embodiments, the cleaning body 610 may have a rectangular parallelepiped shape having an inner space configured to receive, e.g., accommodate, a cleaning solution. Further, the cleaning body 610 may have a length corresponding to a diameter of the polishing head 100. For example, the length of the cleaning body 610 may be substantially equal or similar to the diameter of the polishing head 100. In another example, the length of the cleaning body 610 may be longer than the diameter of the polishing head 100.

As illustrated in FIG. 5, the cleaning body 610 may include a plurality of inlet holes 619 configured to introduced the cleaning solution. The inlet holes 619 may be formed through both side surfaces of the cleaning body 610, e.g., two inlet holes 619 may be at respective opposite ends of the cleaning body 610 along a longitudinal direction of the cleaning body 610. A fitting 650 may be installed at any one of the inlet holes 619. The fitting 650 may be connected at a first end to the inlet hole 619 and at a second end (opposite the first end) to a duct supplying the cleaning solution, e.g., the duct may be connected to a cleaning solution supply and selectively supply the cleaning solution in accordance with the controller operation. A cover 652 may be installed at a remaining inlet hole 619 to prevent a leak of the cleaning solution from the cleaning body 610, e.g., the cover 652 may be at an opposite side surface of the cleaning body 610 relative to the fitting 650.

Further, the cleaning body 610 may have an arc shape having a curvature. In this case, the length of the cleaning body 610 may correspond to a length of a curvature line of the cleaning body 610. The curvature of the cleaning body 610 may correspond to a curvature of the outer circumferential surface of the platen 200. Thus, the cleaning body 610 may include an inner circumferential surface 610*a* contacting (e.g., in direct contact) the outer circumferential surface of the platen 200 (FIG. 4), and an outer circumferential surface 610*b* opposite the inner circumferential surface 610*a*. For example, as illustrated in FIG. 4, the cleaning body 610 may be symmetrical with respect to a central diameter line D among diameter lines of the platen 200. In another example, the cleaning body 610 may be shifted left or right with respect to the central diameter line D of the platen 200.

As further illustrated in FIG. 5, the cleaning body 610 may include a pair of protrusions 611 extended from both ends of the cleaning body 610 (e.g., from respective opposite ends along the longitudinal direction of the cleaning body 610) toward the outer circumferential surface 610*b*, i.e., from the outer circumferential surface 610*b* in a direction oriented away from the inner circumferential surface 610*a*. The protrusions 611 may have an upper surface substantially coplanar with an upper surface of the cleaning body 610. In example embodiments, a curvature line connected between both side surfaces of the cleaning body 610 among the curvature lines of the cleaning body 610 may be a first curvature line C1, e.g., a curvature line extending between opposite ends of the cleaning body 610 along a longitudinal direction of the cleaning body 610 and through a center of the cleaning body 610 may be the first curvature line C1. A curvature line connected between the protrusions 611 may be a second curvature line C2, e.g., a curvature line connecting the protrusions 611 that extend away from the outer circumferential surface 610*b* may be the second curvature line C2. A radius of the second curvature line C2 may be longer than a radius of the first curvature line C1 with respect to a center of the platen 200 (e.g., since the protrusions 611 extend radially beyond the outer circumferential surface 610*b*).

A plurality of the nozzle holes may be formed through upper surfaces of the cleaning body 610 and the protrusions 611. The nozzle holes may be connected to the inner space of the cleaning body 610 (e.g., the inner space may be an interior space of the cleaning body 610 extending through the cleaning body 610 between the inlet holes 619) to receive the cleaning solution in the inner space of the cleaning body 610.

In example embodiments, the nozzle holes may include a plurality of main nozzle holes 612 and at least one auxiliary nozzle hole 612*a*. The main nozzle holes 612 may be formed through the upper surface of the cleaning body 610 along the first curvature line C1, e.g., to form a single row of main nozzle holes 612. The auxiliary nozzle hole 612*a* may be formed through the upper surfaces of the protrusions 611 along the second curvature line C2.

The cleaning nozzles may be inserted into the nozzle holes. The cleaning nozzles may inject the cleaning solution supplied from the nozzle holes to the lower surface of the polishing head 100, i.e., the membrane 120 and the retainer ring 130 (e.g., the gap between the membrane 120 and the retainer ring 130). Further, the cleaning nozzles may be arranged in a vertical direction substantially perpendicular to the upper surface of the cleaning body 610 to inject the cleaning solution to the lower surface of the polishing head 100 in the vertical direction (FIGS. 3 and 5).

In example embodiments, the cleaning nozzles may include a plurality of main nozzles 620 and at least one auxiliary nozzle 620*a*. The main nozzles 620 may be inserted into the main nozzle holes 612. Thus, the main nozzles 620 may be positioned on the first curvature line C1. The auxiliary nozzle 620*a* may be inserted into the auxiliary nozzle hole 612*a*. Thus, the auxiliary nozzle 620*a* may be positioned on the second curvature line C2. For example, the main nozzles 620 may be positioned in a part of the main nozzle holes 612, e.g., the main nozzles 620 may be positioned in only some of the main nozzle holes 612. Numbers of the main nozzles 620 may be determined in accordance with a pollution level generated at the lower surface of the polishing head 100. For example, when the pollution level of the lower surface of the polishing head 100 is high, the main nozzles 620 may be positioned in all the main nozzle holes 612.

The auxiliary nozzle 620*a* may assist a cleaning capacity of outermost main nozzles 620 among the main nozzles 620. In detail, a main direction of the cleaning solution injected from the outermost main nozzles 620 may be oriented toward the gap between the membrane 120 and the retainer ring 130, e.g., toward a region overlapping an edge of the cleaning body 610. Thus, sufficient amounts of the cleaning solution may be injected to the gap between the membrane 120 and the retainer ring 130 from the auxiliary nozzle 620*a* as well as the outermost main nozzles 620 to completely remove the particles from the gap between the membrane 120 and the retainer ring 130. For example, referring to FIG. 5, the auxiliary nozzle 620*a* may increase a number of nozzles arranged along a side surface of the cleaning body 610 (i.e., a side surface including the inlet hole 619), thereby increasing an amount of cleaning solution injected from an edge of the cleaning body 610 (e.g., from a region adjacent to the side surface of the cleaning body 610 that includes a column of a total of two nozzles) toward an edge of the polishing head 100 (i.e., the gap between the membrane 120 and the retainer ring 130).

The cleaner 600 may primarily clean the polishing head 100 and the substrate W at a cleaning position while the polishing head 100 with the substrate W may be moved to the load/unload stage 700 after the CMP process. Further, the cleaner 600 may secondarily clean the polishing head 100 moved back to the cleaning position after the substrate W is unloaded in the load/unload stage 700. The cleaning position may correspond to a position where the cleaner 600 is placed.

Referring again to FIG. 3, the vision system 630 may photograph (e.g., capture an image) the lower surface of the polishing head 100 to obtain an image of the lower surface of the polishing head 100. Particularly, before the cleaning nozzles may inject the cleaning solutions to the lower surface of the polishing head 100, the vision system 630 may photograph the lower surface of the polishing head 100 to obtain the image, not limited thereto. For example, the vision system 630 may photograph the lower surface of the polishing head 100 during the cleaning nozzles may inject the cleaning solutions.

The vision system 630 may include an illuminator 634, a camera 632, and a blower 636. The illuminator 634 may illuminate the lower surface of the polishing head 100, i.e., a surface of the polishing head 100 facing the polishing pad 300. In detail, the illuminator 634 may illuminate the membrane 120, the retainer ring 130, and the gap between the membrane 120 and the retainer ring 130.

The camera 632 may photograph the lower surface of the polishing head 100 illuminated by the illuminator 634, i.e., the membrane 120, the retainer ring 130 and the gap between the membrane 120 and the retainer ring 130, to obtain the image of the lower surface of the polishing head 100. The image of the lower surface of the polishing head 100 may include an image with respect to the membrane 120, the retainer ring 130, and the gap between the membrane 120 and the retainer ring 130. Thus, a defect, e.g., a particle generated at a specific portion of the lower surface of the polishing head 100 (i.e., any portion of the membrane 120, the retainer ring 130 and/or the gap between the membrane 120 and the retainer ring 130) may be accurately checked from the image of the lower surface of the polishing head 100.

The blower 636 may inject a gas to the lower surface of the polishing head 100 to remove particles from the lower surface of the polishing head 100. The removal of the particle using the blower 636 may increase visibility of the image obtained by the camera 632. That is, the particle on the lower surface of the polishing head 100 may be removed by a pressure of the gas injected from the blower 636. If the defect on the lower surface of the polishing head 100 is not removed by the pressure of the gas injected from the blower 636, the vision system 630 may be operated simultaneously with the injection of the cleaning nozzles, so the blower 636 may remove the cleaning solution smeared on the lower surface of the polishing head 100 to provide the image obtained by the vision system 630 with a high visibility. In example embodiments, the gas may include an inert gas, e.g., a nitrogen gas.

The controller 640 may individually control amounts of the cleaning solution injected from the cleaning nozzles based on the image of the lower surface of the polishing head photographed by the vision system 630.

In detail, referring to FIG. 3, the cleaning solution may be supplied to the cleaning body 610 through a manifold 618. The cleaning body 610 and the manifold 618 may be connected between a plurality of cleaning solution lines 614. Each of the cleaning solution lines 614 may be connected to each of the cleaning nozzles. Valves 616 may be installed on the cleaning solution lines 614 to control the amounts of the cleaning solution. The controller 640 may control the operations of the valves 616.

The supplying of the cleaning solution and the amounts of the cleaning solution to the cleaning nozzles may be individually, e.g., independently, controlled by controlling opening/closing of the valves 616 and angles of the opened valves 616 by the controller 640, in accordance with the position of a defect on the lower surface of the polishing head 100. For example, when a position of the defect is recognized from the image of the lower surface of the polishing head 100 obtained by the vision system 630, a cleaning nozzle among all the cleaning nozzles corresponding to the position of the defect may be opened, while the remaining cleaning nozzles may be closed, so that the cleaning solution may be injected to the position of the defect through, e.g., only, the corresponding cleaning nozzle. In another example, the angle of the opened cleaning nozzle corresponding to the position of the defect may be wider than the angles of the open remaining cleaning nozzles, so that the amount of the cleaning solution injected from the corresponding nozzle toward the defect may be larger than the amount of the cleaning solution injected from the remaining cleaning solution.

FIGS. 7 to 10 are plan views illustrating an operation of the cleaner 600 in FIG. 4.

Figure 7:
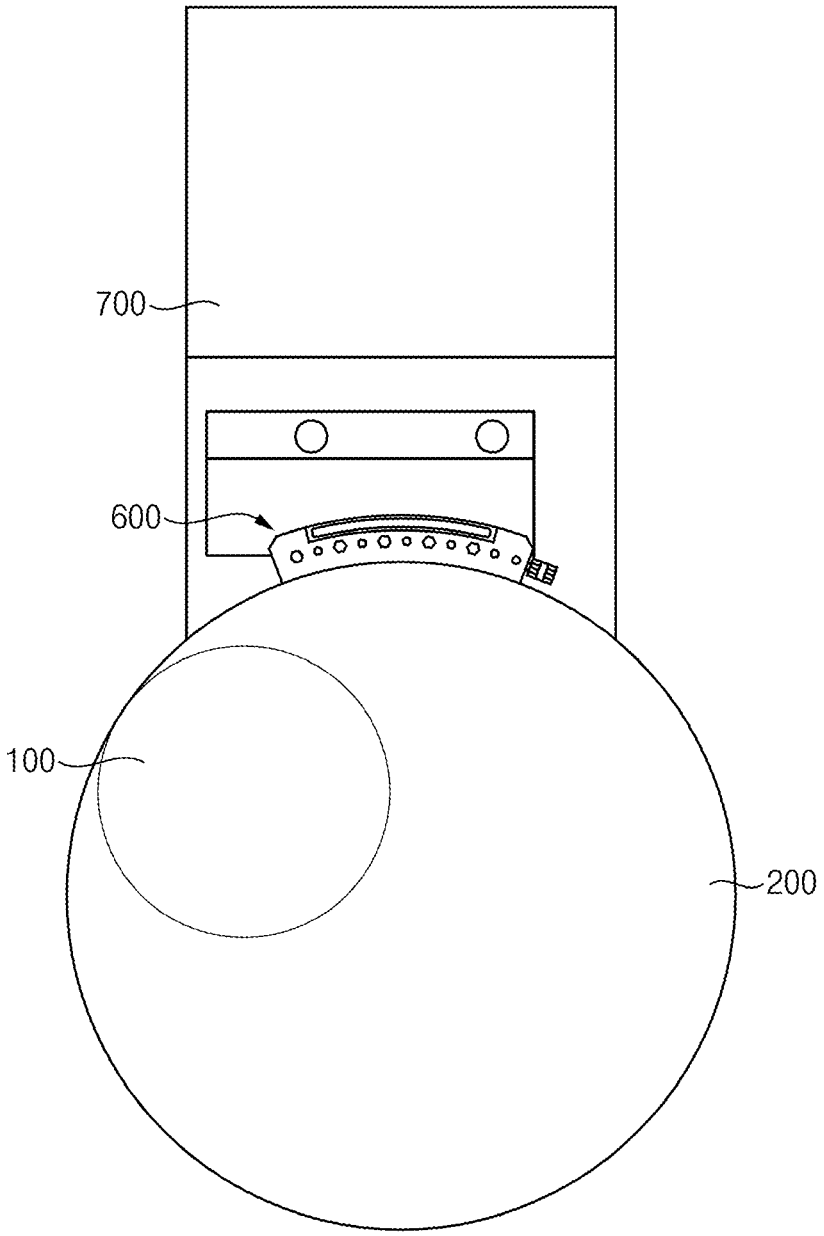
FIGS. 7 to 10 are plan views illustrating an operation of the cleaner in FIG. 4.

Referring to FIG. 7, the polishing head 100 with the substrate may be moved over the platen 200 from the load/unload stage 700. For example, at this point, the polishing head 100 with the substrate may be moved over the upper surface of the platen 200 to perform a CMP process on the substrate.

Figure 8:
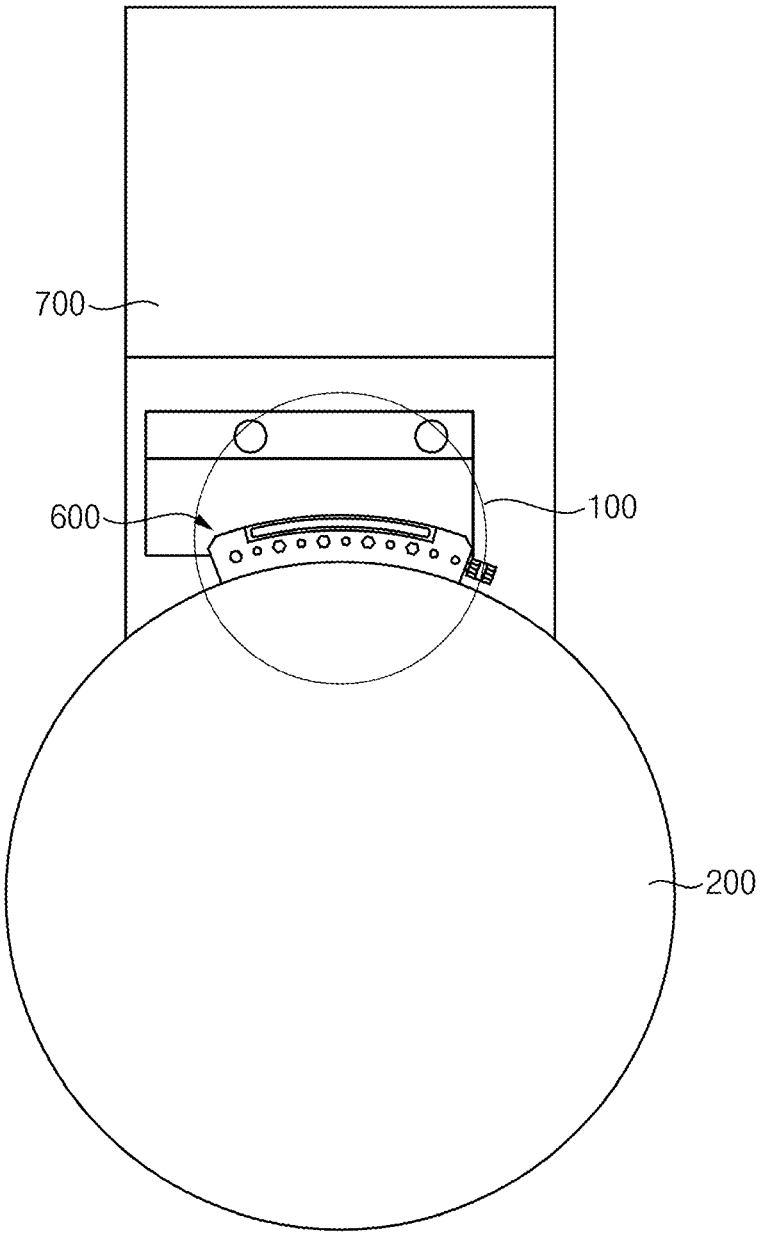

Referring to FIG. 8, after completing the CMP process, the polishing head 100 with the substrate may be moved from the platen 200 back to the load/unload stage 700 (e.g., to unload the substrate) through the cleaning position where the cleaner 600 is placed. While the polishing head 100 is moved over the cleaner 600 (i.e., on the way to the load/unload stage 700), the cleaner 600 may inject the cleaning solution to the lower surface of the polishing head 100 to clean the polishing head 100 and the substrate W. In detail, the outermost main nozzles 620 and the auxiliary nozzle 620*a* may concentratedly inject the cleaning solution to the gap between the membrane 102 and the retainer ring 130 of the polishing head 100 to completely remove any defects from the gap.

Before the cleaning process, the vision system 630 may photograph the lower surface of the polishing head 100 to obtain an image of the lower surface of the polishing head 100. The controller 640 may recognize the position of the defect based on the image. The controller 640 may individually control the operations of the cleaning nozzles in accordance with the position of the defect. The cleaning operation of the cleaner 600 may be continuously performed while the polishing head 100 is moved through the cleaning position, i.e., over the cleaner 600.

Figure 9:
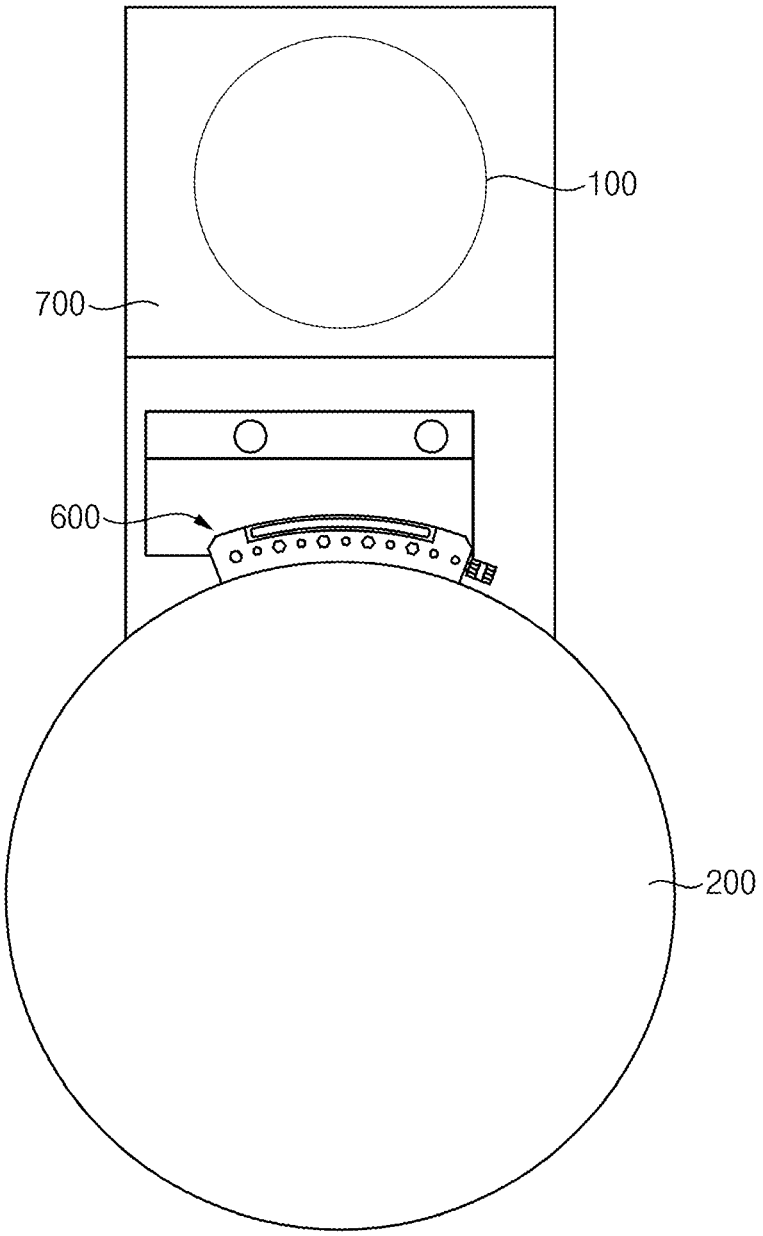

Referring to FIG. 9, after completing the primary cleaning of the polishing head 100 by the cleaner 600, the polishing head 100 with the substrate may be loaded into the load/unload stage 700. The substrate, on which the CMP process has been performed, may be unloaded from the load/unload stage 700.

Figure 10:
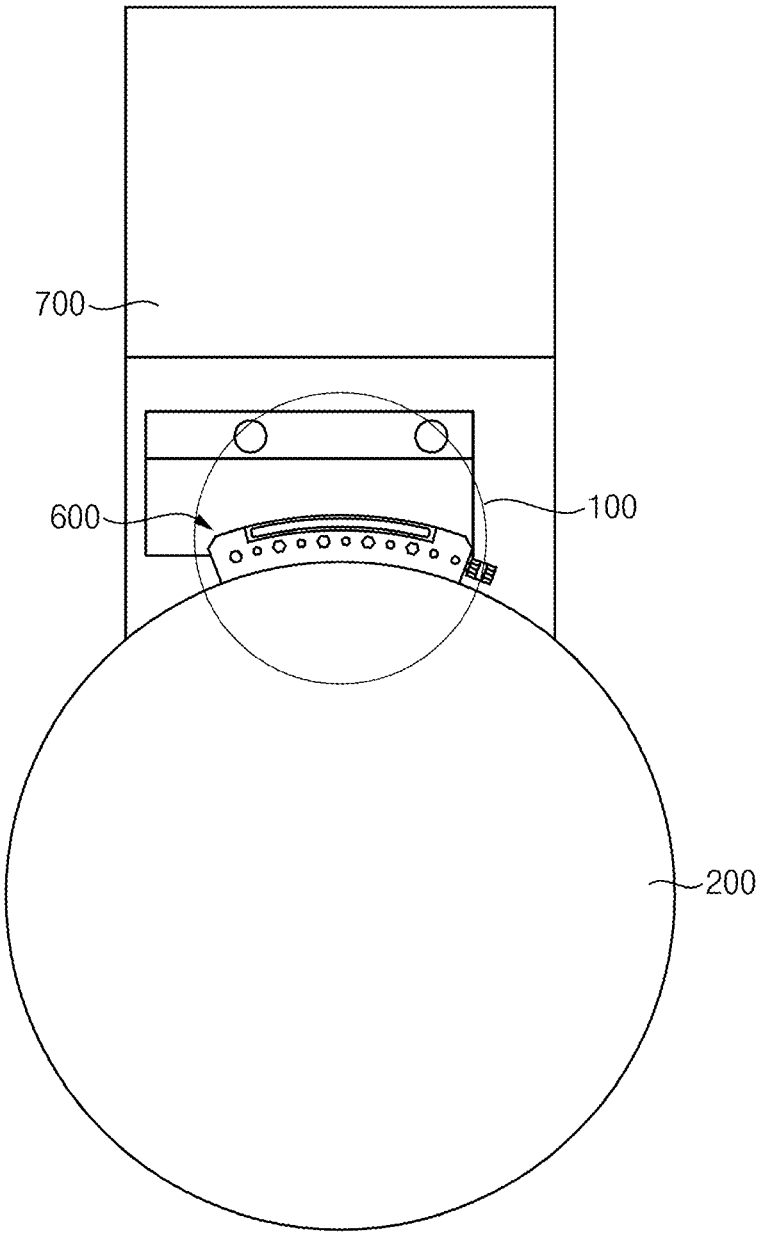

Referring to FIG. 10, the polishing head 100 (i.e., without the substrate) may be moved to the cleaning position. The cleaner 600 may inject the cleaning solution to the lower surface of the polishing head 100 to remove any defects from the lower surface of the polishing head, i.e., from the membrane 120, the retainer ring 130, and the gap between the membrane 120 and the retainer ring 130.

By way of summation and review, a defect generated in a CMP process may remain in a gap between a membrane and a retainer arranged on a lower surface of the polishing pad. Such a defect may cause a scratch on the semiconductor substrate.

In contrast, example embodiments provide a cleaner capable of effectively removing a defect generated in a CMP process, as well as a CMP apparatus including the cleaner. That is, according to example embodiments, cleaning nozzles of a cleaner may inject a cleaning solution to the membrane and the retainer ring to effectively remove a defect from the membrane and the retainer ring. Particularly, the cleaning nozzles may effectively remove a defect from the gap between the membrane and the retainer ring. Thus, a scratch caused by the defect may not be generated at the substrate.

The methods, processes, and/or operations described herein (e.g., with respect to the controller 640 or the vision system 630) may be performed by code or instructions to be executed by a computer, processor, controller, or other signal processing device. The computer, processor, controller, or other signal processing device may be those described herein or one in addition to the elements described herein. The algorithms, code or instructions for implementing the operations of the method embodiments herein may transform the computer, processor, controller, or other signal processing device into a special-purpose processor for performing the methods herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A cleaner for a chemical mechanical polishing (CMP) apparatus, the cleaner comprising:

a cleaning body with an interior space, the interior space being configured to accommodate a cleaning solution for cleaning a polishing head, and the cleaning body being arranged under the polishing head that holds a substrate;

cleaning nozzles extending from the cleaning body, the cleaning nozzles being configured to inject the cleaning solution to the polishing head;

a vision system configured to photograph the polishing head to obtain an image of the polishing head; and a controller configured to individually control amounts of the cleaning solution injected from the cleaning nozzles based on the image of the polishing head.

2. The cleaner as claimed in claim 1, wherein the cleaning body is positioned between a platen with a polishing pad and a load/unload stage of the polishing head.

3. The cleaner as claimed in claim 2, wherein the cleaning body has a curvature corresponding to a curvature of an outer circumferential surface of the platen, the cleaning body being in direct contact with the outer circumferential surface of the platen.

4. The cleaner as claimed in claim 1, wherein the cleaning body includes inlet holes at opposite side surfaces of the cleaning body, the inlet holes being connected to a cleaning solution supply.

5. The cleaner as claimed in claim 4, further comprising:

a fitting connected to one of the inlet holes, the fitting being selectively connected to a duct of the cleaning solution supply; and a cover connected to another of the inlet holes, the cover covering the interior space of the cleaning body.

6. The cleaner as claimed in claim 4, wherein the cleaning nozzles extend vertically from an upper surface of the cleaning body, the upper surface of the cleaning body being perpendicular to the opposite side surfaces of the cleaning body.

7. The cleaner as claimed in claim 6, wherein the cleaning nozzles include:

main nozzles arranged in a first curvature line of the cleaning body; and at least one auxiliary nozzle arranged in a second curvature line of the cleaning body.

8. The cleaner as claimed in claim 7, wherein outermost ones of the main nozzles and the at least one auxiliary nozzle are positioned at an edge of the cleaning body, the outermost ones of the main nozzles and the at least one auxiliary nozzle being configured to inject the cleaning solution to a membrane, a retainer ring, and a gap between the membrane and the retainer ring.

9. The cleaner as claimed in claim 1, wherein the vision system includes:

an illuminator configured to illuminate the polishing head; and a camera configured to photograph the polishing head illuminated by the illuminator.

10. The cleaner as claimed in claim 9, wherein the vision system further includes a blower configured to inject a gas toward the polishing head.

11. The cleaner as claimed in claim 1, wherein the cleaning nozzles are connected to cleaning solution lines, respectively, each of the cleaning solution lines including a valve independently controllable by the controller.

12. A cleaner for a chemical mechanical polishing (CMP) apparatus, the cleaner comprising:

a cleaning body under a polishing head, which is configured to hold a substrate, the cleaning body being configured to receive a cleaning solution for cleaning the polishing head;

cleaning nozzles extending from the cleaning body, the cleaning nozzles being configured to inject the cleaning solution to a lower surface of the polishing head;

a vision system configured to photograph the lower surface of the polishing head to obtain an image of the lower surface of the polishing head; and a controller configured to individually control amounts of the cleaning solution injected from the cleaning nozzles based on the image of the lower surface of the polishing head, wherein the cleaning body has an arc shape having a curvature corresponding to a curvature of an outer circumferential surface of a platen under the polishing head, the cleaning body being in direct contact with the outer circumferential surface of the platen, wherein the cleaning nozzles include main nozzles arranged in a first curvature line of the cleaning body, and at least one auxiliary nozzle arranged in a second curvature line of the cleaning body, wherein the vision system includes an illuminator configured to illuminate the polishing head, a camera configured to photograph the polishing head illuminated by the illuminator, and a blower configured to inject a gas to the polishing head, and wherein the cleaning nozzles are connected to cleaning solution lines, respectively, each of the cleaning solution lines including a valve controlled by the controller.

13. The cleaner as claimed in claim 12, wherein the cleaning body is positioned between the platen and a load/unload stage of the polishing head.

14. The cleaner as claimed in claim 12, wherein the cleaning body includes inlet holes at opposite side surfaces of the cleaning body, the inlet holes being connected to a cleaning solution supply.

15. The cleaner as claimed in claim 14, further comprising:

a fitting connected to one of the inlet holes, the fitting being selectively connected to a duct of the cleaning solution supply; and a cover connected to another of the inlet holes, the cover covering an interior space of the cleaning body.

16. The cleaner as claimed in claim 12, wherein:

the main nozzles are arranged in a single row along the first curvature line; and the at least one auxiliary nozzle arranged is in the second curvature line at an edge of the cleaning body, a radius of the second curvature line being larger than a radius of the first curvature line, and an outermost one of the main nozzles with the at least one auxiliary nozzle define a column of at least two nozzles along the edge of the cleaning body.

17. A cleaner for a chemical mechanical polishing (CMP) apparatus, the cleaner comprising:

a cleaning body with an interior space, the interior space being configured to accommodate a cleaning solution for cleaning a polishing head, and the cleaning body being arranged under the polishing head that holds a substrate;

cleaning nozzles extending from the cleaning body, the cleaning nozzles being configured to inject the cleaning solution to the polishing head;

a vision system configured to photograph the polishing head to obtain an image of the polishing head; and a controller configured to individually control amounts of the cleaning solution injected from the cleaning nozzles based on the image of the polishing head, wherein the cleaning body is positioned between a platen with a polishing pad and a load/unload stage of the polishing head, wherein the cleaning body includes inlet holes at opposite side surfaces of the cleaning body, the inlet holes being connected to a cleaning solution supply, wherein a fitting is connected to one of the inlet holes, the fitting being selectively connected to a duct of the cleaning solution supply, and a cover is connected to another of the inlet holes, the cover covering the interior space of the cleaning body.

18. The cleaner as claimed in claim 17, wherein the cleaning body has a curvature corresponding to a curvature of an outer circumferential surface of the platen, the cleaning body being in direct contact with the outer circumferential surface of the platen.

19. The cleaner as claimed in claim 17, wherein the cleaning nozzles extend vertically from an upper surface of the cleaning body, the upper surface of the cleaning body being perpendicular to the opposite side surfaces of the cleaning body.

20. The cleaner as claimed in claim 19, wherein the cleaning nozzles include:

main nozzles arranged in a first curvature line of the cleaning body; and at least one auxiliary nozzle arranged in a second curvature line of the cleaning body.

* * * * *